US005214809A

United States Patent [19]

Stuart

[11] Patent Number: 5,214,809

[45] Date of Patent: Jun. 1, 1993

[54] ARTICULATED MATTRESS FOR ADJUSTABLE BED

[76] Inventor: Paul Stuart, 228 Pine Hov Cir., C-1, Lake Worth, Fla. 33463

[21] Appl. No.: 905,308

[22] Filed: Jun. 29, 1992

[51] Int. Cl.[5] ..... A47C 27/04

[52] U.S. Cl. ..... 5/465; 5/477

[58] Field of Search ..... 5/249, 471, 477, 465

[56] References Cited

U.S. PATENT DOCUMENTS

| | | | |
|---|---|---|---|
| 2,033,841 | 3/1936 | Maddux | 5/405 X |
| 2,550,293 | 4/1951 | Platis | 5/246 |
| 2,674,745 | 4/1954 | Burke, Sr. | 5/465 X |
| 3,242,505 | 3/1966 | Tyhanic | 5/246 |
| 3,256,535 | 6/1966 | Anson | 5/351 |
| 3,316,568 | 5/1967 | Janapol | 5/465 |
| 3,467,972 | 9/1969 | Bastos et al. | 5/465 |
| 4,523,344 | 6/1985 | Stumpf et al. | 5/465 X |
| 4,662,011 | 5/1987 | Duvivier | 5/465 X |
| 4,928,737 | 5/1990 | Chauncey | 5/465 |
| 4,985,951 | 1/1991 | Lacotte et al. | °5/465 |
| 5,066,001 | 11/1991 | Wilkinson | 272/70 |

FOREIGN PATENT DOCUMENTS

| | | | |
|---|---|---|---|
| 239470 | 11/1960 | Australia | 5/465 |
| 107695 | 6/1965 | Denmark | 5/465 |
| 2744412 | 4/1979 | Fed. Rep. of Germany | 5/465 |

*Primary Examiner*—Michael F. Trettel
*Attorney, Agent, or Firm*—Alvin S. Blum

[57] ABSTRACT

A mattress of an adjustable bed is readily bendable at joints connecting non-bendable sections. Each non-bendable section is composed of a non-bendable assembly of rows and columns of spring coils held in place by top and bottom border wires, edge support elements between the border wires and longitudinal straps on the top and bottom of each column of coils to provide a durable spring assembly with uniform support throughout. A bag assembly of sturdy fabric has a series of pockets to hold the spring assemblies in place spaced apart from one another by a fixed gap defined by a transverse hinge portion of the bag assembly positioned at the mid thickness of the mattress so that the joints formed by the hinge may bend either way for reversing the mattress top to bottom. Resilient foam bars fill the gaps between pockets and conventional mattress padding and covering are secured to the bag assembly.

8 Claims, 1 Drawing Sheet

ARTICULATED MATTRESS FOR ADJUSTABLE BED

BACKGROUND OF THE INVENTION

This invention relates to mattresses and more particularly to articulated innerspring mattresses for adjustable beds. Hospital beds are frequently made with four sections that may be adjusted relative to one another for comfort and therapeutic purposes. Beds of this type are now often found in homes as well. Mattresses for these adjustable beds should have all of the body supporting properties of flat mattresses while also being bendable at the joints of the articulated sections. Because of the additional requirements put on mattresses to make them bendable at the joints, prior art mattresses made for these beds have a very short useful life. They rapidly lose their support at the joints and at the edges.

Conventional innerspring mattresses are supplied with sturdy border wires along top and bottom edges to prevent sagging. Further support may be provided by side edge supports between top and bottom wires. The individual coils are further stabilized by top and bottom longitudinal straps joining all the coils in longitudinal rows. These stabilizing and reinforcing structures make the mattress uniformly resilient in the direction required to support the horizontal body.

However, these same structures resist bending as required on an articulated bed. Consequently, they are not provided on mattresses of the prior art designed for articulated beds. As a result, articulated mattresses of the prior art have very short useful lives and do not provide the uniform body support necessary for this application. The springs distort at the folds from bending and at the edges from the reduced coil support and extra forces from sitting on the edge of the bed.

SUMMARY OF THE INVENTION

It is accordingly an object of the invention to provide an articulated innerspring mattress that provides the uniformity of support, stability, and durability of high quality non-bendable innerspring mattresses. It is another object that the mattress have border wires and edge support elements and longitudinal strap members while still being readily folded for use on articulated and folding beds. It is yet another object that the mattress resist distortion at the joints, both of the spring support structure and of the various layers covering the springs. It is yet another object that the mattress be bilaterally symmetrical so that it can be turned over without any loss of function.

The mattress of the invention comprises a plurality of rectangular spring segments. Each segment corresponding to the sections of the articulated bed on which it will be used. Each segment is constructed using the quality supporting construction found on non-bendable innerspring mattresses including border wires, because no segment will be subjected to bending. The individual spring segments are held in place by a bag assembly formed of sturdy fabric. The bag assembly has a plurality of pockets, each pocket shaped to receive a spring assembly to which it is firmly stapled. The bag assembly holds the spring segments in alignment and spaced apart from one another about two inches by a hinge strap portion of the bag assembly at a level that is at the mid point of the mattress thickness. Two resilient foam spacer bars fasten to the top and bottom of the hinge strap to fill the gap between spring segments. The bag assembly with all the gaps between segments filled with spacer bars is then covered top, bottom and sides with various layers in the fashion well known in the art to provide a mattress which bends readily at the hinge straps with the resilient foam spacer bars preventing distortion of the covering materials as well as holding the spring assemblies in correct position.

These and other objects, advantages and features of the invention will become more apparent when the detailed description is studied in conjunction with the drawings.

DETAILED DESCRIPTION OF PREFERRED EMBODIMENTS

Figures 1, 2, 3, 3A, 3B, 4:
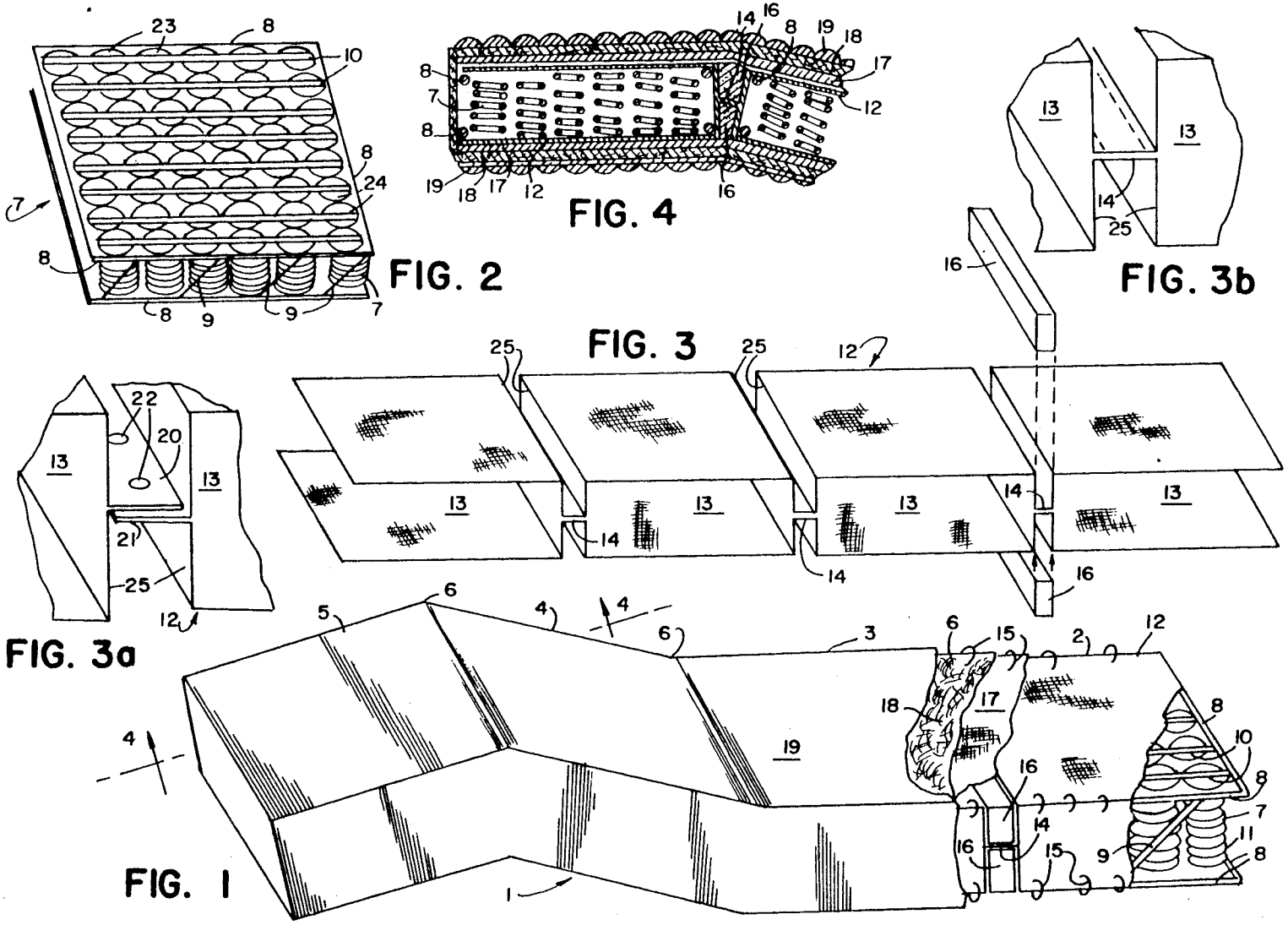
FIG. 1 is a perspective view of the mattress of the invention with portions broken away.
FIG. 2 is a perspective view of a spring segment of the invention.
FIG. 3 is a perspective view of a bag assembly of the invention.
FIGS. 3*a* and 3*b* show details of portions of the bag assembly of FIG. 3.
FIG. 4 is a sectional view taken through line 4—4 of FIG. 1.

Referring now first to FIGS. 1 and 4, an articulated innerspring mattress 1 of the invention comprises four rectangular, non-bendable sections. Head 2, trunk 3, thigh 4, and foot 5 sections are connected by flexible joints 6, all covered with padding and covering materials to provide a smooth surface with uniform body support throughout that is very durable and resistant to distortions and failure from frequent bending at the joints. The support in each section is provided by a rectangular innerspring segment 7 as shown in FIG. 2. The segment 7 is constructed with top and bottom border wires 8 and rows 23 and columns 24 of coil springs 11. Certain transverse border wires may be omitted where there is low stress as at knee joint.

Each innerspring segment 7 may be provided with any or all of the well known structures to enhance durability and uniformity of support including Bonnel, Offet, continuous wire or pocketed configuration. Anson, U.S. Pat. No. 3,256,535 and Thynic U.S. Pat. No. 3,242,505 exemplify innerspring mattress structure. The supporting structures may include edge support elements 9 between border wires and top and bottom longitudinal strap members 10. These support elements resist bending, but provide greater uniformity of support over the entire surface and prevent distortion of the springs which leads to early failure.

As best seen in FIGS. 3, 3*a* and 3*b*, a bag assembly 12 formed of a sturdy fabric, is provided to hold the individual innerspring segments 7 in correct position, while providing controlled articulation.

The bag 12 has pockets 13, each one arranged to securely receive an innerspring segment 7 to which it is secured by hog ring type staples 15. Joining each pocket is a transverse hinge portion 14 of the bag assembly that is positioned on adjacent and confronting sides 25 at the midpoint of the mattress thickness so that the mattress will be bilaterally symmetrical, bending either way at the joints 6 formed by the transverse hinge portions 14. The mattress may then be reversed top for bottom for greater mattress life.

The hinge portions 14 space the pockets and innerspring segments 7 apart about two inches. Resilient foam spacer bars 16 fill this space. They are cemented to the upper and lower surfaces of the hinge portions. By filling this space with a resilient material, covering layers are prevented from being distorted as the joint is flexed, while the joint retains support consistent with adjacent non-bendable areas.

The various covering layers are applied to the bag assembly in the conventional fashion of high quality innerspring mattress construction, including, for example, the stiffening insulator pad 17, the topper or cushioning pad 18, and the quilted cover 19. These methods are well known and need not be repeated here.

The bag assembly may be constructed in various ways, such as by sewing top and bottom layers together selectively as shown. As shown in FIG. 3, each pocket 13 may be provided with separate flanges 20 and 21 which are grommetted together by grommets 22 to form the hinge portion 14.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. An articulated mattress comprising:

A) a plurality of substantially non-bendable, rectangular coil spring assemblies, each assembly including:

1) a plurality of coil springs arranged in an array of rows and columns;

2) top and bottom border wires connected to the outermost columns of springs;

3) top and bottom border wires connected to at least one outermost row of springs;

B) a bag assembly including:

1) a plurality of pocket means for receiving and securely holding in place said spring coil assemblies with a single coil assembly fitted into a single pocket means, each said pocket means having sides and at least one side being adjacent and in confronting relationship with a side of another, adjacent pocket means;

2) a transverse hinge portion connecting confronting sides of adjacent pocket means, said hinge portion disposed at a midpoint of the thickness of said mattress and spacing said pocket means apart by a fixed distance gap;

C) a plurality of resilient foam spacer bars connected to said bag assembly, with a pair of said spacer bars fitted into the fixed distance gap between adjacent pocket means, with one of said pair attached to a top face of said hinge portion and another of said pair attached to a bottom face of said hinge portion; and D) covering means for covering and cushioning said mattress secured in multiple layers to said bag assembly to thereby construct a mattress having the support and durability of a non-bendable innerspring mattress while providing for bending at said hinge portions.

2. The mattress according to claim 1, further comprising edge support elements connecting said top and bottom border wires for enhanced edge support.

3. The mattress according to claim 2, further comprising top and bottom longitudinal strap members fastened along the columns of coils.

4. The mattress according to claim 1, further comprising top and bottom longitudinal strap members fastened along the columns of coils.

5. An articulated mattress comprising:

A) a plurality of substantially non-bendable, rectangular coil spring assemblies, each assembly including:

1) a plurality of coil springs arranged in an array of rows and columns;

2) Top and bottom border wires connected to the outermost columns of springs;

B) a bag assembly including:

1) a plurality of pocket means for receiving and securely holding in place said spring coil assemblies with a single coil assembly fitted into a single pocket means, each said pocket means having sides and at least one side being adjacent and in confronting relationship with a side of another, adjacent pocket means;

2) a transverse hinge portion connecting confronting sides of adjacent pocket means, said hinge portion disposed at a midpoint of the thickness of said mattress and spacing said pocket means apart by a fixed distance gap;

C) a plurality of resilient foam spacer bars connected to said bag assembly, with a pair of said spacer bars fitted into the fixed distance gap between adjacent pocket means, with one of said pair attached to a top face of said hinge portion and another of said pair attached to a bottom face of said hinge portion; and D) covering means for covering and cushioning said mattress secured in multiple layers to said bag assembly to thereby construct a mattress having the support and durability of a non-bendable innerspring mattress while providing for bending at said hinge portions.

6. The mattress according to claim 5, further comprising edge support elements connecting said top and bottom border wires for enhanced edge support.

7. The mattress according to claim 6, further comprising top and bottom longitudinal strap members fastened along the columns of coils.

8. The mattress according to claim 5, further comprising top and bottom longitudinal strap members fastened along the columns of coils.

* * * * *